US007748543B2

(12) United States Patent
Yang et al.

(10) Patent No.: US 7,748,543 B2
(45) Date of Patent: Jul. 6, 2010

(54) TILTING DISH RACK ASSEMBLY

(75) Inventors: Frank Yang, Rancho Palos Verdes, CA (US); Adam C. Wade, Rancho Santa Margarita, CA (US)

(73) Assignee: Simplehuman LLC, Torrance, CA (US)

( * ) Notice: Subject to any disclaimer, the term of this patent is extended or adjusted under 35 U.S.C. 154(b) by 1296 days.

(21) Appl. No.: 11/026,254

(22) Filed: Dec. 29, 2004

(65) Prior Publication Data

US 2006/0137725 A1 Jun. 29, 2006

(51) Int. Cl.
*A47G 19/08* (2006.01)

(52) U.S. Cl. ..... 211/41.3

(58) Field of Classification Search ..... 211/41.3, 211/41.2, 41.1, 85, 85.26, 195, 126.1
See application file for complete search history.

(56) References Cited

U.S. PATENT DOCUMENTS

| | | | | |
|---|---|---|---|---|
| 591,377 | A | 10/1897 | Bunch | |
| 1,604,608 | A | 10/1926 | Ryerson | |
| 1,682,654 | A | 8/1928 | Andrews | |
| 1,789,232 | A | 1/1931 | Hertz | |
| D97,654 | S | 11/1935 | Watral | |
| 2,020,503 | A * | 11/1935 | Hanson et al. | 248/188.5 |
| 2,443,404 | A | 6/1948 | Tallarico | |
| 2,479,118 | A | 8/1949 | Jenness | |
| D164,197 | S | 8/1951 | Planeta | |
| 2,655,267 | A | 10/1953 | Planeta | |
| 2,708,037 | A | 5/1955 | Planeta | |
| 2,739,715 | A | 3/1956 | Planeta | |
| 2,864,509 | A | 12/1958 | Watral | |
| 2,885,087 | A | 5/1959 | Bliss | |
| 2,886,087 | A | 5/1959 | Pasinski | |
| 2,936,898 | A | 5/1960 | Miguez | |
| D189,311 | S | 11/1960 | Christoffersen | |
| 3,027,041 | A | 3/1962 | Stansbury, Jr. | |
| 3,203,557 | A | 8/1965 | Ettlinger, Jr. | |
| 3,217,890 | A | 11/1965 | Maslow | |
| 3,433,363 | A | 3/1969 | Clearman | |
| 3,442,395 | A | 5/1969 | Taylor | |
| 3,889,837 | A * | 6/1975 | Wilson | 220/7 |

(Continued)

FOREIGN PATENT DOCUMENTS

| | | |
|---|---|---|
| DE | 4202851 | 8/1993 |

(Continued)

OTHER PUBLICATIONS

Partial European Search Report & Lack of Unity of Invention of Related Case EP05257985, dated Jul. 16, 2007.

*Primary Examiner*—Sarah Purol
(74) *Attorney, Agent, or Firm*—Liu & Liu

(57) ABSTRACT

A dish rack assembly has a dish rack, and a base having a bottom wall on which the dish rack is positioned. The base includes a first edge having a first water outlet provided adjacent the first edge, and a second edge having a second water outlet provided adjacent the second edge. The second edge is adjacent to the first edge. A removable water stopper can be secured to either the first water outlet or the second water outlet. In addition, a first leg can be positioned adjacent a third edge that is opposite to the first edge, and a second leg can be positioned adjacent a fourth edge that is opposite to the second edge.

25 Claims, 13 Drawing Sheets

U.S. PATENT DOCUMENTS 3,941,273 A 3/1976 Dalencon
3,960,290 A 6/1976 Yake et al.
D271,339 S 11/1983 Lee
D273,904 S 5/1984 Pacheco
4,480,343 A * 11/1984 Drach ..... 4/656
4,531,641 A * 7/1985 Archambault ..... 211/41.3
4,635,799 A 1/1987 Penner
D288,374 S 2/1987 Ikeda
D288,375 S 2/1987 Okami
D306,926 S 3/1990 Heller et al.
4,974,806 A 12/1990 Matern
4,974,896 A 12/1990 Matern
5,012,934 A * 5/1991 Newhall ..... 211/41.3
D321,771 S 11/1991 Cavicchia
5,119,943 A * 6/1992 Hoang ..... 211/41.3
5,158,184 A 10/1992 Craft et al.
D347,718 S 6/1994 Craft et al.
D353,921 S 12/1994 Lippisch et al.
5,431,294 A 7/1995 Stottmann et al.
D363,578 S 10/1995 Brightbill et al.
D370,323 S 5/1996 Lafond
D373,866 S 9/1996 Belden et al.
D376,882 S 12/1996 Cook
5,588,539 A * 12/1996 Belden et al. ..... 211/41.3
5,605,236 A 2/1997 Welch
5,660,117 A * 8/1997 Noble ..... 108/35
5,704,492 A 1/1998 Bartko
D391,696 S 3/1998 Bournay et al.
5,775,518 A 7/1998 Connor
D398,725 S 9/1998 Merkel
D408,603 S 4/1999 Haley
D423,160 S * 4/2000 Lenney ..... D32/55
6,062,397 A * 5/2000 Licari ..... 211/41.3
6,109,455 A 8/2000 Schroeder
D439,716 S 3/2001 Wright
D446,370 S 8/2001 Adikimenakis et al.
6,282,084 B1 * 8/2001 Goerdt et al. ..... 361/679.55
D448,132 S 9/2001 Wolfenden
6,364,130 B2 4/2002 Wright
6,364,131 B1 4/2002 Moylan
6,371,312 B1 4/2002 Tsuchida
6,491,170 B1 * 12/2002 Madela ..... 211/41.3
6,659,406 B2 12/2003 Tsuchida
D488,891 S 4/2004 Smith et al.
6,729,440 B1 * 5/2004 Bailey ..... 182/204
7,063,219 B2 * 6/2006 Fann et al. ..... 211/74
7,077,277 B2 * 7/2006 Wang ..... 211/206
7,325,695 B2 * 2/2008 Yang et al. ..... 211/41.3
2002/0185166 A1 12/2002 Rosenbauer et al.
2004/0144738 A1 7/2004 Sampaio
2004/0238464 A1 12/2004 Cheung
2005/0167374 A1 8/2005 Yang et al.
2007/0131629 A1 6/2007 Sullivan et al.
2007/0144984 A1 6/2007 Sullivan et al.

FOREIGN PATENT DOCUMENTS

DE 20201103 6/2003
EP 0385877 9/1990
EP 0729725 4/1996
EP 1384432 1/2004
GB 724313 2/1955
GB 2295958 6/1996
GB 2363316 12/2001
JP 10328117 12/1998
JP 2001169994 6/2001
JP 2003105820 4/2003

* cited by examiner

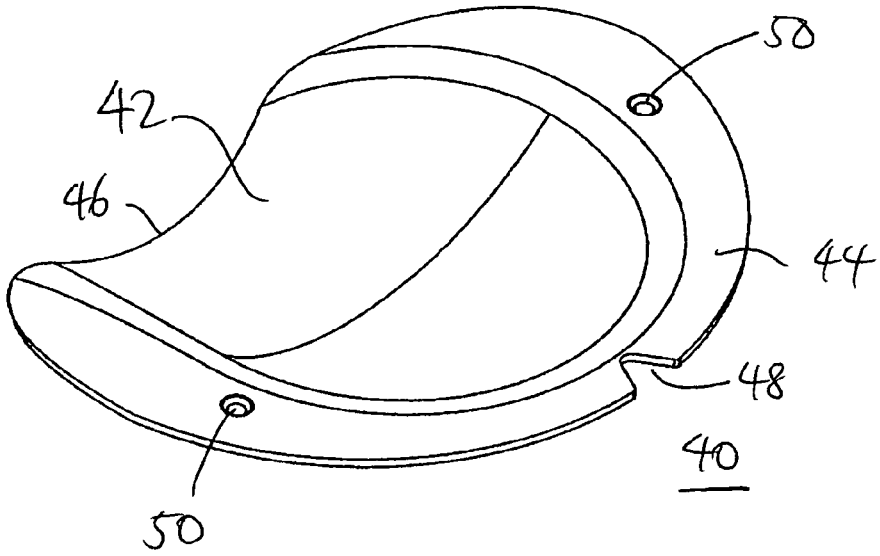
FIG. 7A
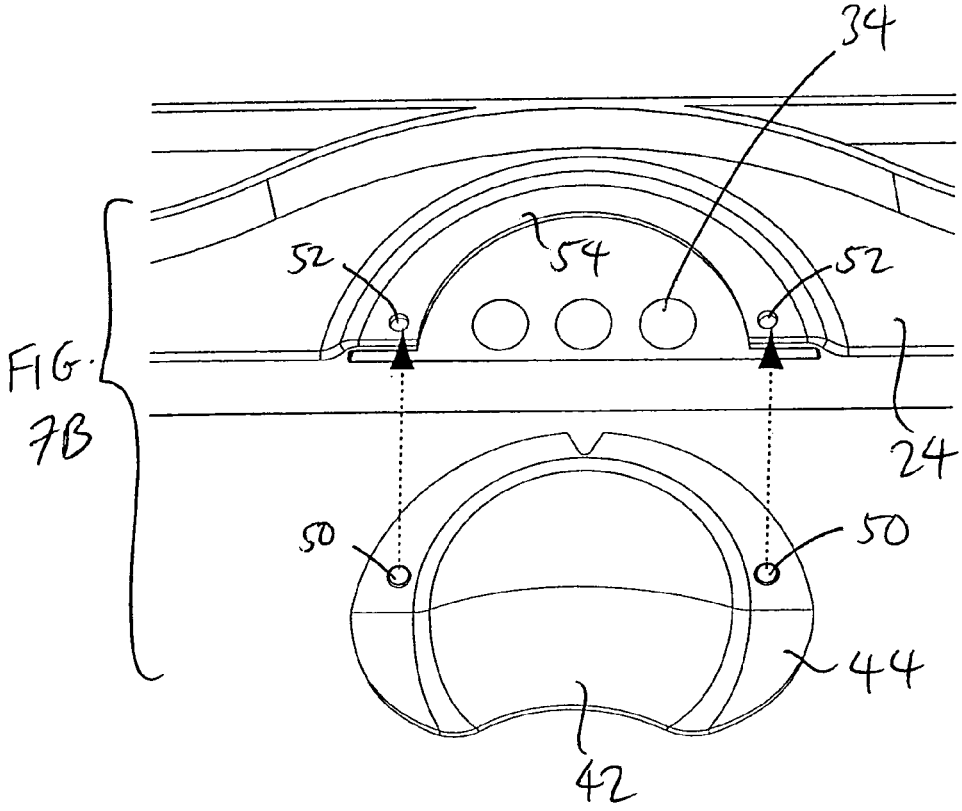

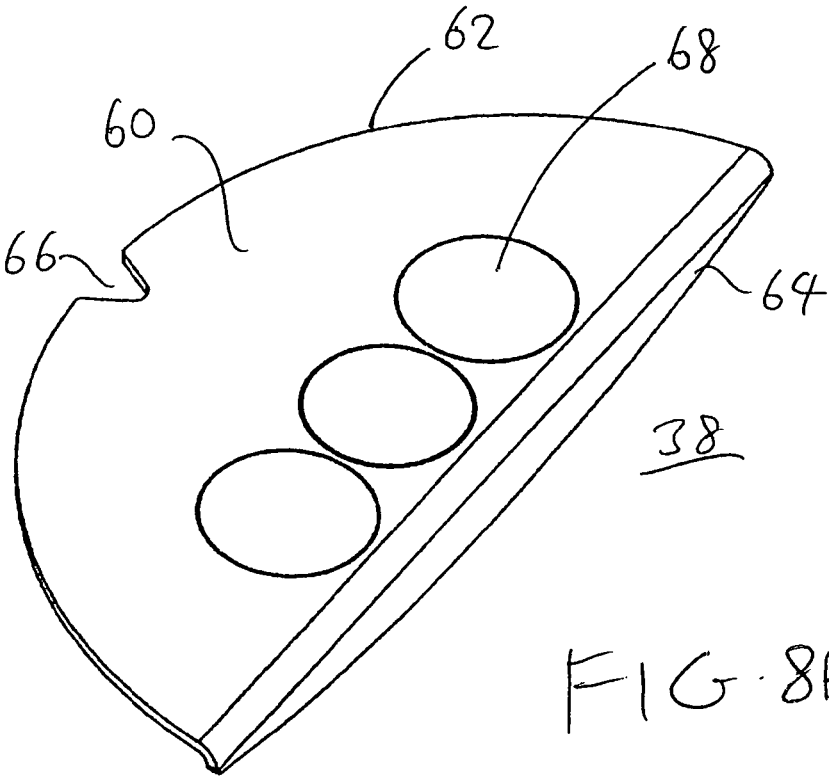
FIG. 8A
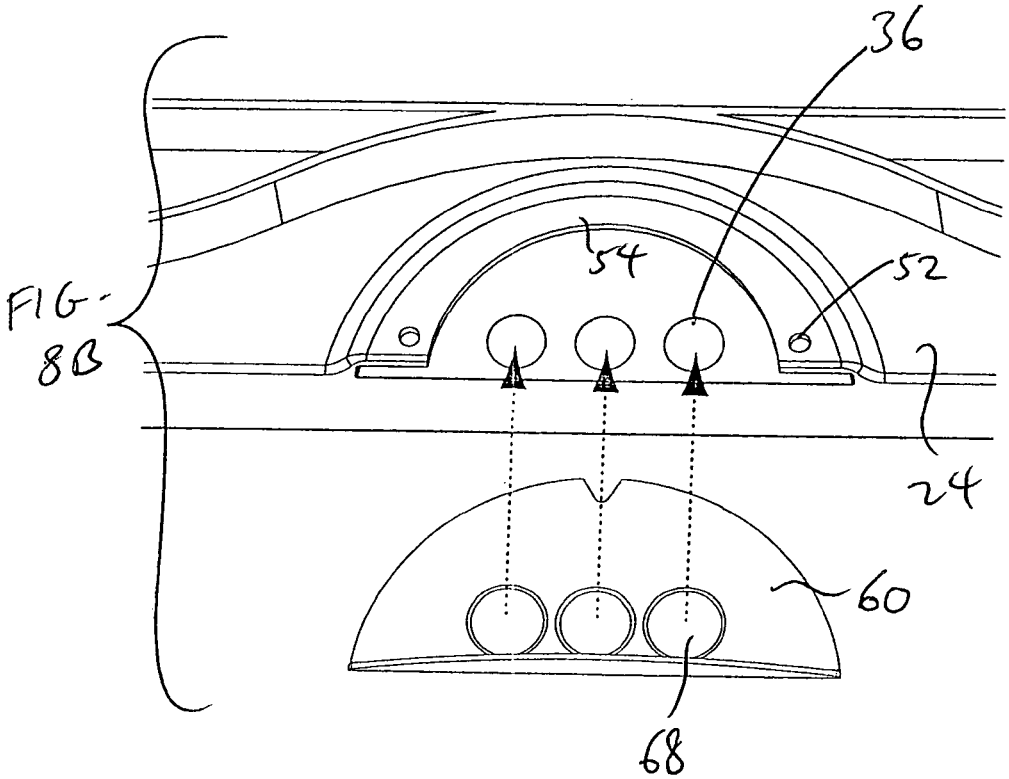

TILTING DISH RACK ASSEMBLY

BACKGROUND OF THE INVENTION

1. Field of the Invention

The present invention relates to dish racks and their accessories, and in particular, to a dish rack having a tilting base that allows water to be drained from the base.

2. Description of the Prior Art

Dish racks are commonly used on kitchen countertops for positioning plates, bowls, cups and utensils to let them dry after they have been washed. The water from the washed plates, bowls, cups and utensils will typically drip on to the base of the dish rack, and the water can be drained to the kitchen sink by tilting the base.

The base for conventional dish racks is typically rectangular in shape to allow a long edge of the dish rack to be positioned adjacent an edge of the kitchen sink. Conventional kitchens found in older homes typically have a narrow kitchen counter so that the conventional rectangular dish racks would normally have to be positioned with their short edge adjacent an edge of the kitchen sink. However, kitchens being designed in newer homes now have deeper kitchen counters, so that it is sometimes desirable to position the long edge of a rectangular dish rack adjacent an edge of the kitchen sink.

In light of the different orientations of kitchen counters and kitchen sinks that are available today, it is desirable to provide dish rack assemblies that have the flexibility of being able to position either a long edge or a short edge of the dish rack adjacent an edge of the kitchen sink.

SUMMARY OF THE DISCLOSURE

It is an object of the present invention to provide a dish rack that can effectively drain water from its base into a kitchen sink.

It is another object of the present invention to provide a dish rack that can be positioned in different orientations while effectively draining water from its base into a kitchen sink.

In order to accomplish the objects of the present invention, the present invention provides a dish rack assembly having a dish rack, and a base having a bottom wall on which the dish rack is positioned. The base includes a first edge having a first water outlet provided adjacent the first edge, and a second edge having a second water outlet provided adjacent the second edge. The second edge is adjacent to the first edge. A removable water stopper can be secured to either the first water outlet or the second water outlet.

According to one embodiment of the present invention, a first leg is positioned adjacent a third edge that is opposite to the first edge, and a second leg is positioned adjacent a fourth edge that is opposite to the second edge.

BRIEF DESCRIPTION OF THE DRAWINGS

FIG. 7A is a perspective view of a spout that can be used with the assembly of FIG. 1.

FIG. 7B is an enlarged and exploded bottom perspective view illustrating how the spout of FIG. 7A is removably coupled to the base of the assembly of FIG. 1.

FIG. 8A is a perspective view of a water stopper that can be used with the assembly of FIG. 1.

FIG. 8B is an enlarged and exploded bottom perspective view illustrating how the stopper of FIG. 8A is removably coupled to the base of the assembly of FIG. 1.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
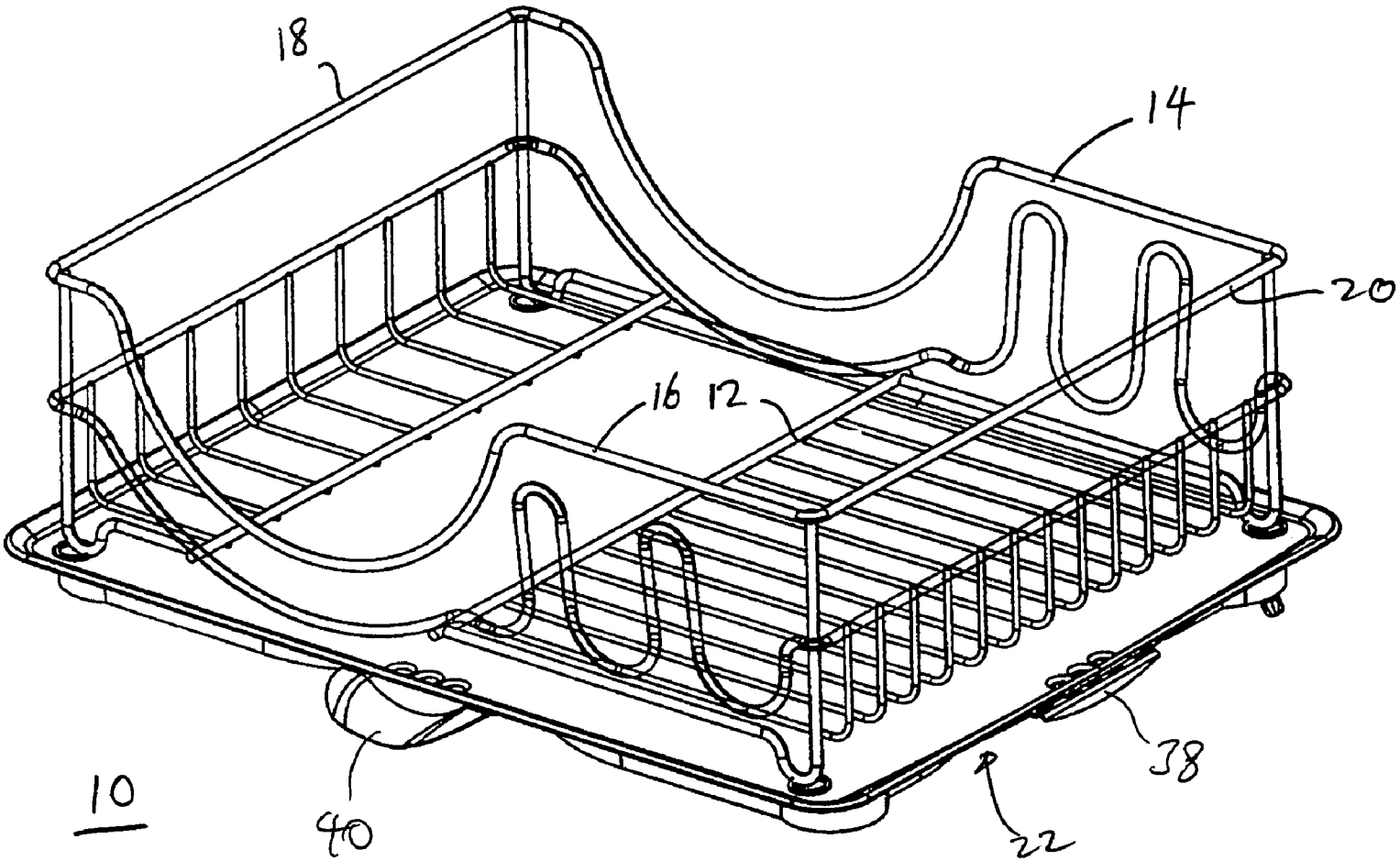
FIG. 1 is a perspective view of a dish rack assembly according to one embodiment of the present invention.
Figure 2:
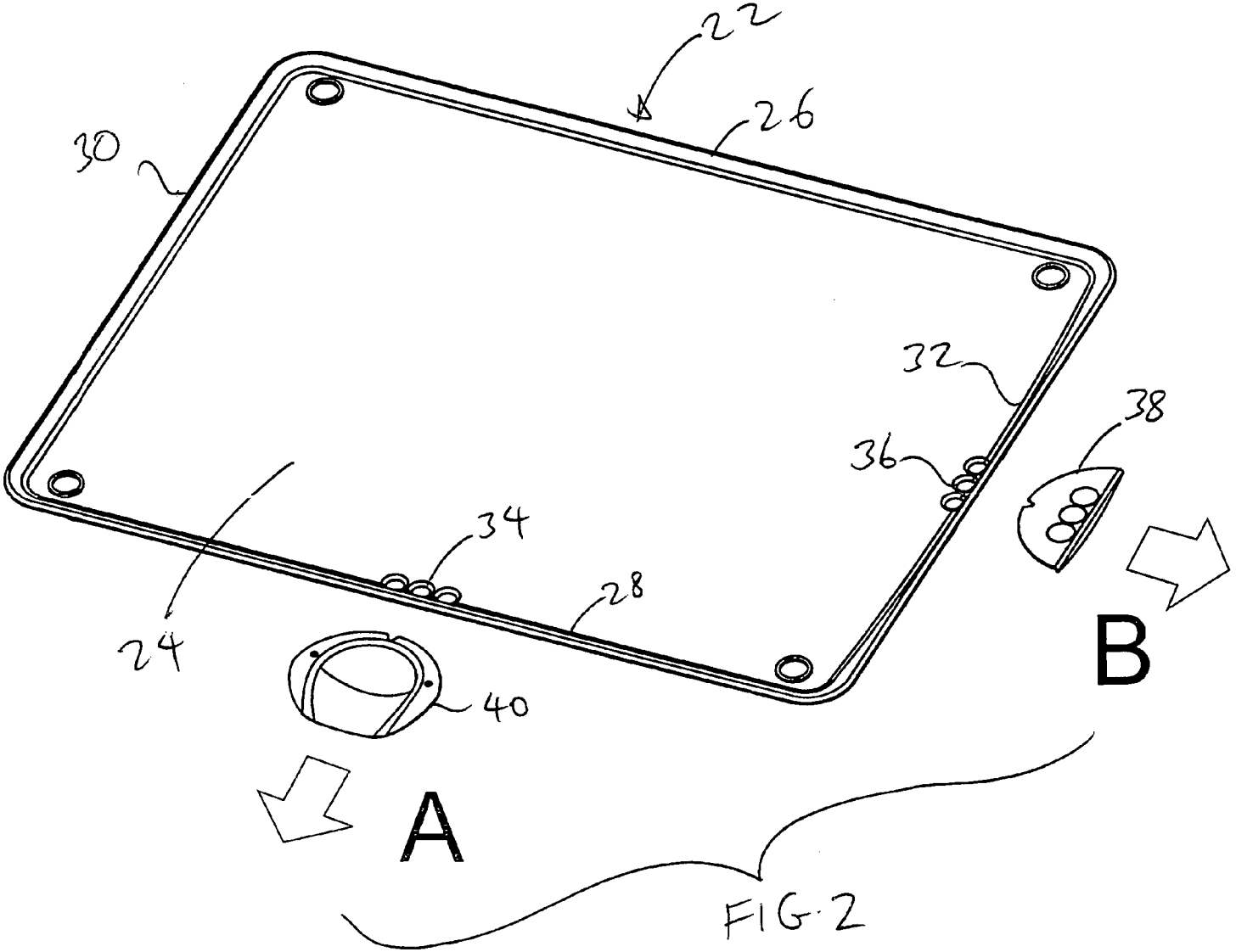
FIG. 2 is an exploded top perspective view of the base of the assembly of FIG. 1.

FIG. 1 illustrates a dish rack assembly having a generally four-sided (e.g., rectangular) dish rack 10 according to the present invention. The dish rack 10 can be any conventional metal, sheet or plastic dish rack. For example, a conventional metal wire frame dish rack would include a wire frame base 12 for receiving plates and large bowls, and a divider section (not shown) along the wire frame base 12 that has a plurality of divider walls (not shown) for receiving plates. Two sets of horizontal side wire segments 14 and 16 form two opposing sides of the four-sided dish rack 10, and two horizontal end wire segments 18 and 20 form the other two opposing sides of the four-sided dish rack 10. The disk rack 10 can be positioned on top of a base 22 that is sized and configured to fit completely below the dish rack 10.

Figure 3:
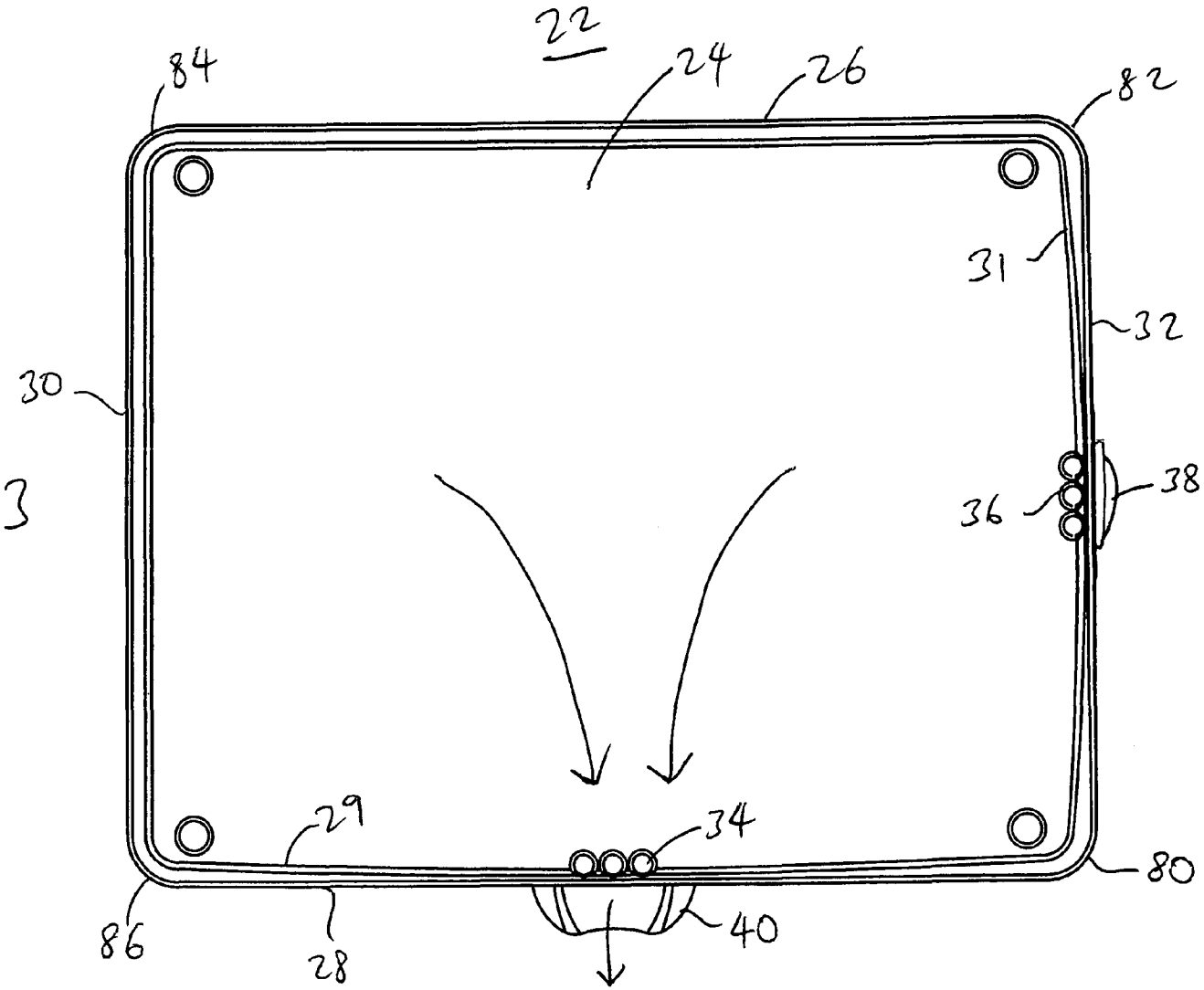
FIG. 3 is an assembled top plan view of the base of the assembly of FIG. 1 shown with water being drained from a long edge thereof.
Figure 4:
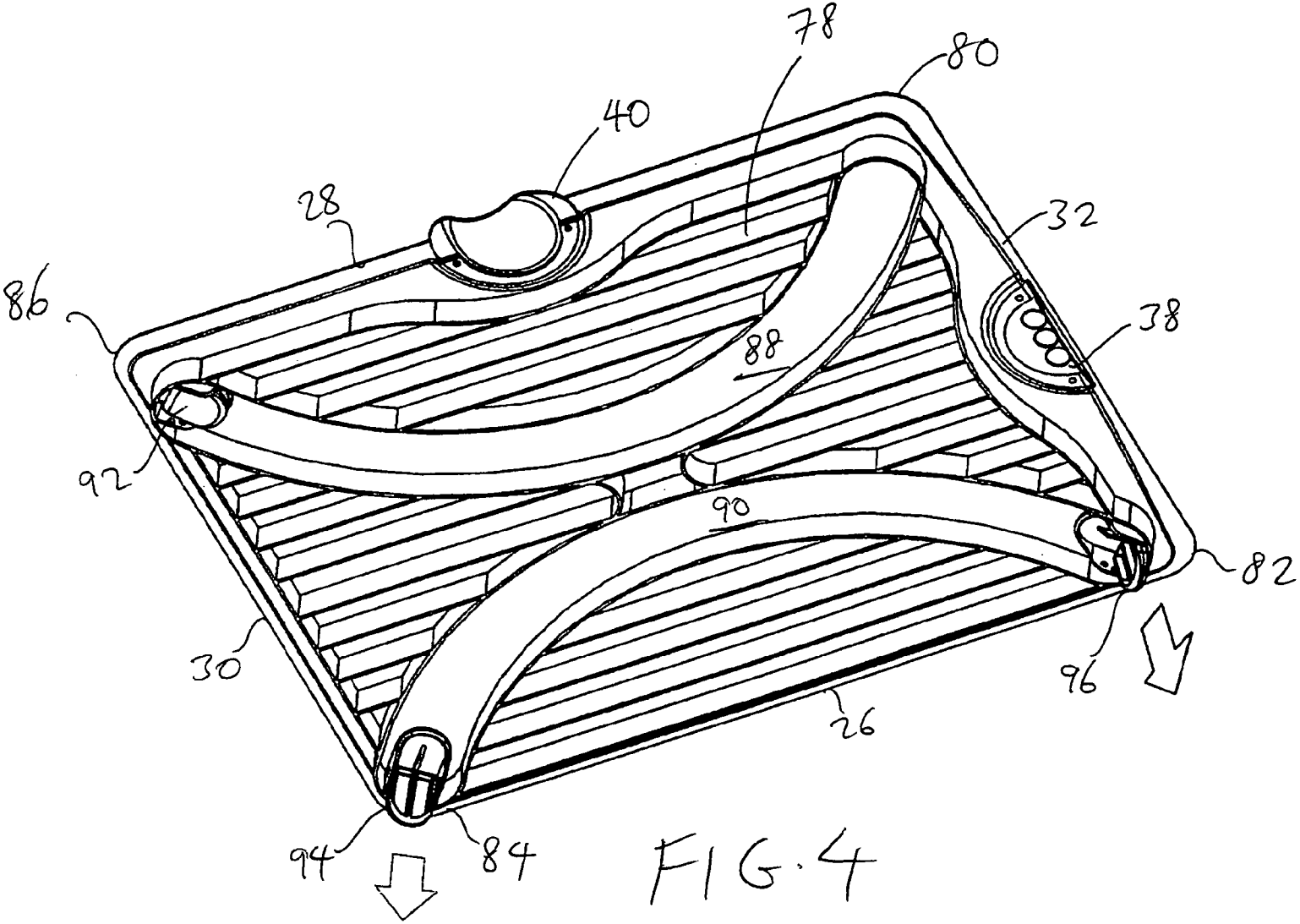
FIG. 4 is a bottom perspective view of the base of the assembly of FIG. 1 shown with the legs along a long edge thereof being deployed.
Figure 5:
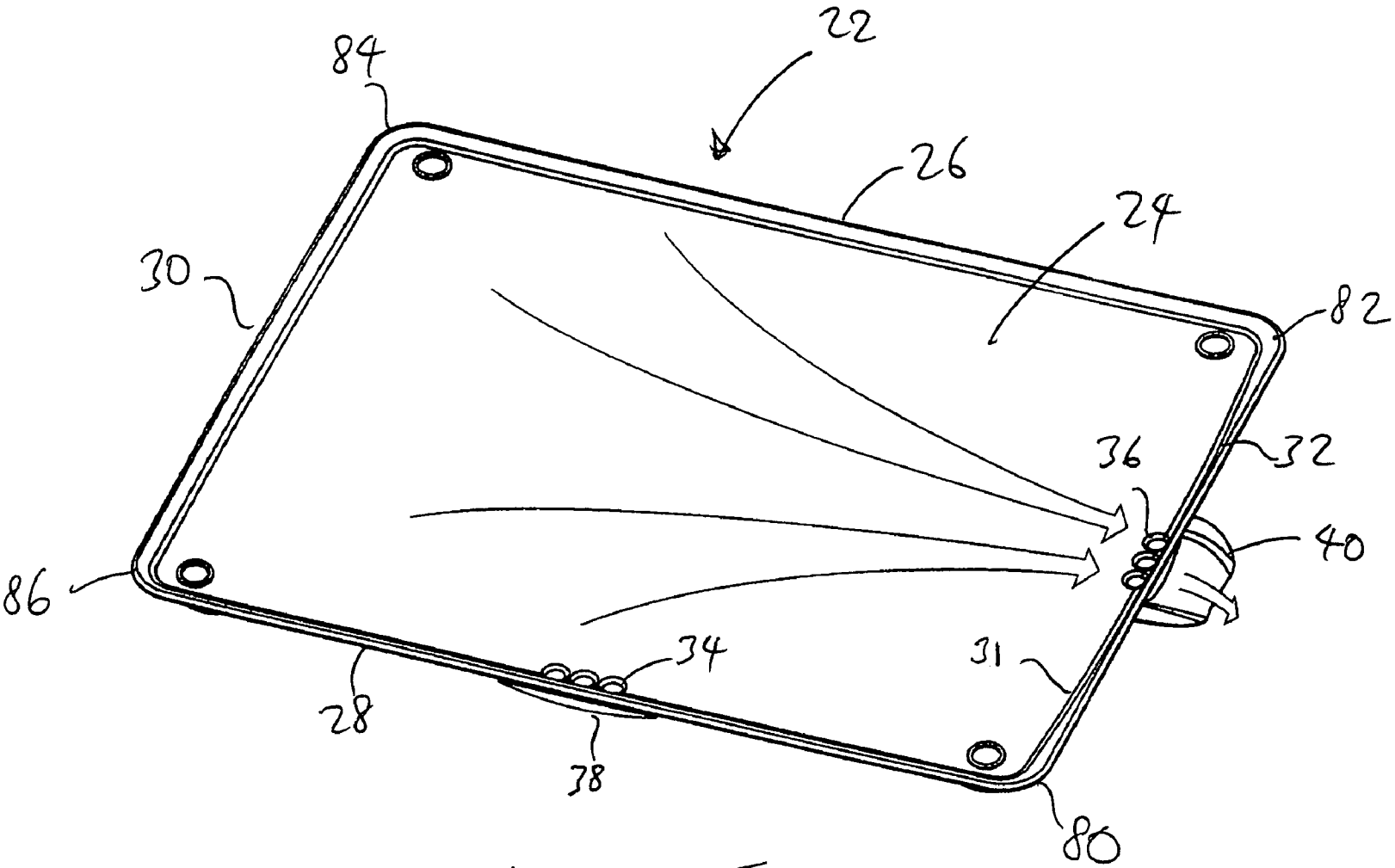
FIG. 5 is an assembled top perspective view of the base of the assembly of FIG. 1 shown with water being drained from a short edge thereof.
Figure 6:
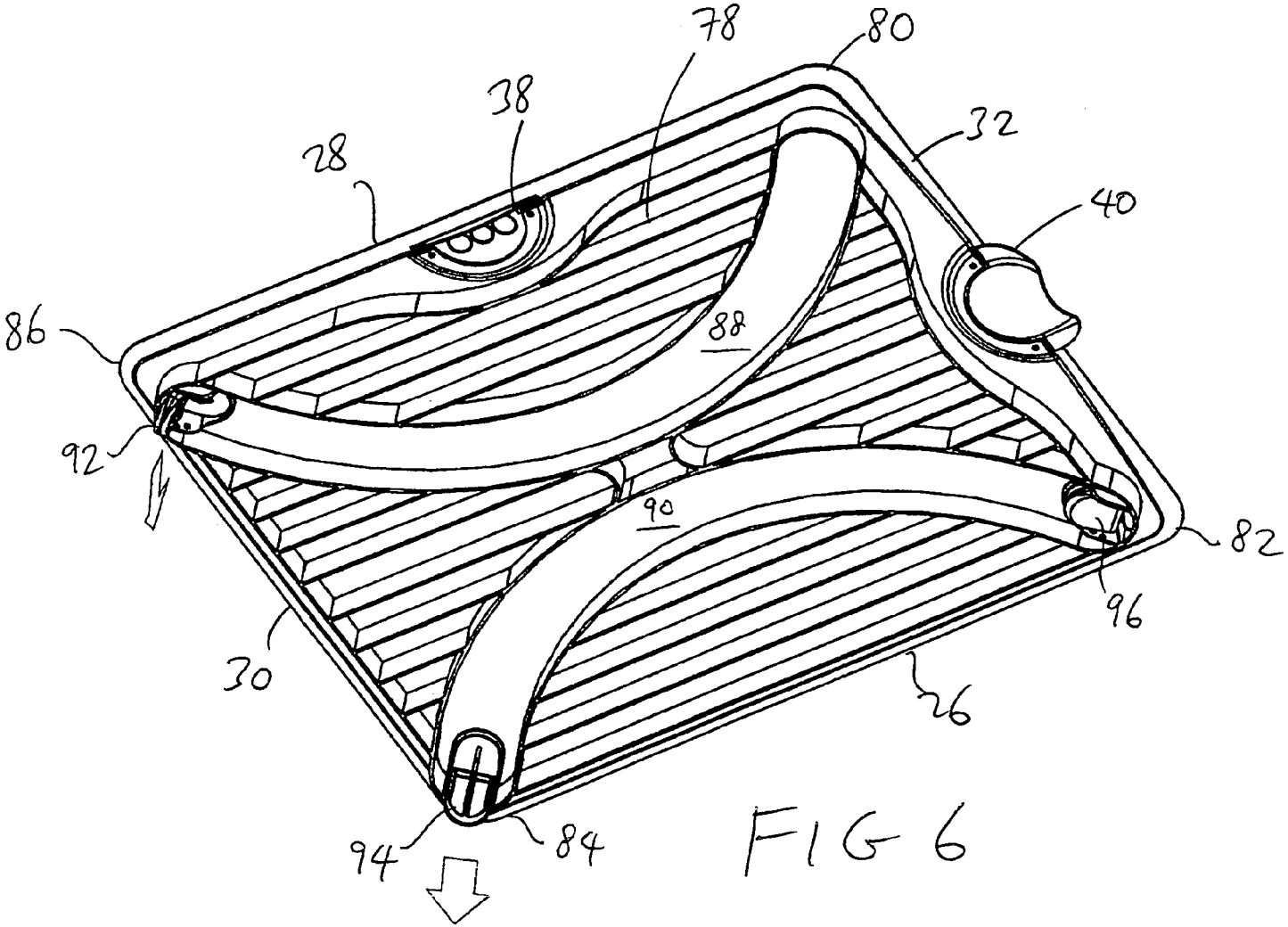
FIG. 6 is a bottom perspective view of the base of the assembly of FIG. 1 shown with the legs along a short edge thereof being deployed.

The base 22 is illustrated in greater detail in FIGS. 2-8. The base 22 is configured like a pan with a bottom wall 24 and very short side walls, which can be vertical or angled. Two opposing side walls define the long edges 26, 28 of the base 22, and the other two opposing side walls define the short edges 30, 32 of the base 22. A plurality of water outlets 34 are clustered together along one of the long edges 28, and another plurality of water outlets 36 are clustered together along one of the short edges 32. Thus, these sets of water outlets 34 and 36 are positioned generally perpendicular (i.e., 90 degrees apart from) to each other. A water stopper 38 can be removably secured to either set of outlets 34 or 36, and a spout 40 can be removably secured to the other set of outlets 36 or 34. For example, FIGS. 3 and 4 illustrate the spout 40 secured to the outlets 34 and the water stopper 38 secured to the outlets 36, while FIGS. 5 and 6 illustrate the spout 40 secured to the outlets 36 and the water stopper 38 secured to the outlets 34.

Referring to FIGS. 7A and 7B, the spout 40 has a concave body 42 that is surrounded by a generally U-shaped border plate 44 and a straight edge 46. A V-shaped notch 48 is provided at the center of the U-shape of the border plate 44. The concave body 42 is angled so that water from the outlets 34 or 36 can flow down the concave body 42 from the border plate 44 (adjacent the notch 48) towards the straight edge 46 where the water can be flowed into a kitchen sink. A pair of bumps 50 are also provided on the bottom side of the border plate 44 for removably engaging a corresponding pair of openings 52 provided in a generally semi-circular shelf 54 that is provided on the bottom of the bottom wall 24 adjacent the water outlets 34 and 36. In particular, the border plate 44 is adapted to be slid into the space between the bottom wall 24 and the shelf 54 so that each bump 50 is adapted to be fitted into a corresponding opening 52 to secure the spout 40 at a desired set of water outlets 34 or 36, as best shown in FIG. 7B. To disengage the spout 40 from a particular set of water outlets 34 or 36, the user merely grips the concave body 42 and pulls the spout 40 from the shelf 54, which will dislodge each bump 50 from each corresponding opening 54.

The spout 40 is entirely optional and merely assists in channeling the water on the base 22 into the kitchen sink. The spout 40 can be omitted, such that the water on the base 22 will flow through the water outlets 34 or 36 directly to the kitchen sink.

Referring to FIGS. 8A and 8B, the water stopper 38 has a semi-circular plate 60 that has a curved edge 62 and a straight gripping flange 64. A V-shaped notch 66 is provided along the curved edge 62 at the center thereof. A plurality of bumps 68 are provided on the plate 60 adjacent the flange 64, and are positioned on the plate 60 in a manner which allows each bump 68 to be aligned with one of the outlets 34 and 36 in each set of outlets 34, 36. Each bump 68 is adapted to removably engage a corresponding water outlet 34 or 36. In particular, the plate 60 is adapted to be slid into the space between the bottom wall 24 and the shelf 54 so that each bump 68 is adapted to be fitted into a corresponding water outlet 34 or 36 to secure the water stopper 38 at a desired set of water outlets 34 or 36, as best shown in FIG. 8B. To disengage the water stopper 38 from a particular set of water outlets 34 or 36, the user merely grips the gripping flange 64 and pulls the water stopper 38 from the shelf 54, which will dislodge each bump 68 from each corresponding water outlet 34 or 36.

Figure 9:
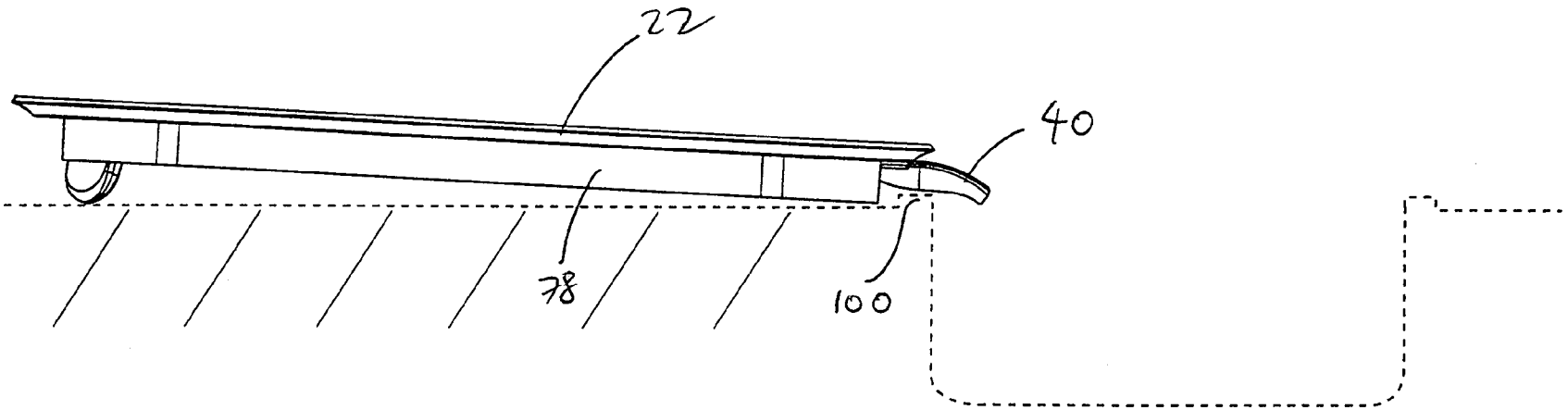
FIG. 9 is a side plan view illustrating the base of the assembly of FIG. 1 in use adjacent an over mount sink.

FIGS. 4 and 6 illustrate the bottom of the base 22. A plurality of ribs 78 can be provided on the bottom of the base 22. These ribs 78 are entirely optional, and perform the function of allowing the base 22 to clear an over mount sink 100, as shown in FIG. 9. The base 22 defines four corners: 80 (between edges 28 and 32), 82 (between edges 26 and 32), 84 (between edges 30 and 26) and 86 (between edges 28 and 30). Two curved regions 88 and 90 can be defined among the ribs 78. A first curved region 88 extends from the corner 80 to the corner 86, and a second curved region 90 extends from the corner 82 to the corner 84.

A first pivotable leg 92 is provided at one end of the curved region 88 adjacent the corner 86, a second pivotable leg 94 is provided at one end of the curved region 90 adjacent the corner 84, and a third pivotable leg 96 is provided at the other end of the curved region 90 adjacent the corner 82. Each pivotable leg 92, 94, 96 can be pivoted between a deployed position where it extends perpendicular to the base 22, and a storage position where it extends parallel to the base 22. Thus, the legs 92 and 94 are provided along the short edge 30, and the legs 94 and 96 are provided along the long edge 26. In other words, the legs 92, 94 are positioned opposite to the outlets 36, while the legs 94, 96 are positioned opposite to the outlets 34.

The dish rack 10 and its base 22 can be used in the following manner. Before the disk rack 10 is being used to dry plates, bowls and utensils, two of the legs 92, 94, 96 are pivoted to their deployed position (as described in greater detail below) so that the base 22 is tilted at an angle with respect to the horizontal surface (e.g., the kitchen counter top). See FIG. 9. To drain the water from the base 22, the spout 40 can be secured to one of the sets of the outlets 34 or 36, and the water stopper 38 can be secured to the one of the sets of the outlets 36 or 34, depending on the orientation of the disk rack 10. Alternatively, the spout 40 can be omitted, then the water can be drained directly from either set of openings 34 or 36.

Figure 10A:
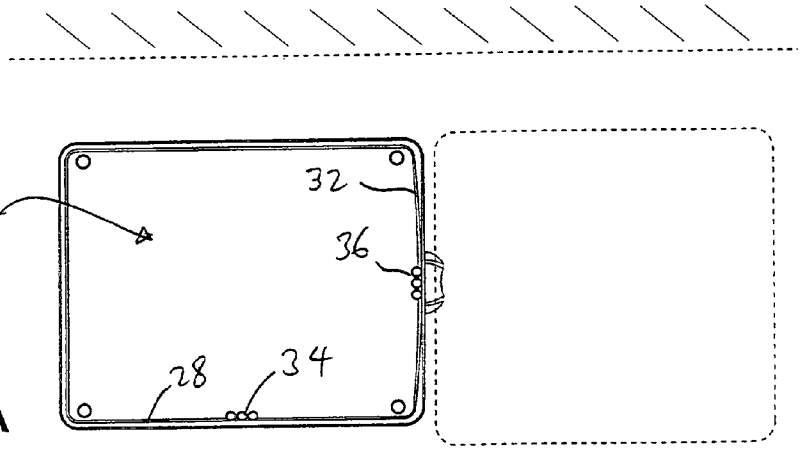
FIG. 10A illustrates the assembly of FIG. 1 oriented with a short edge adjacent a kitchen sink.
Figure 10B:
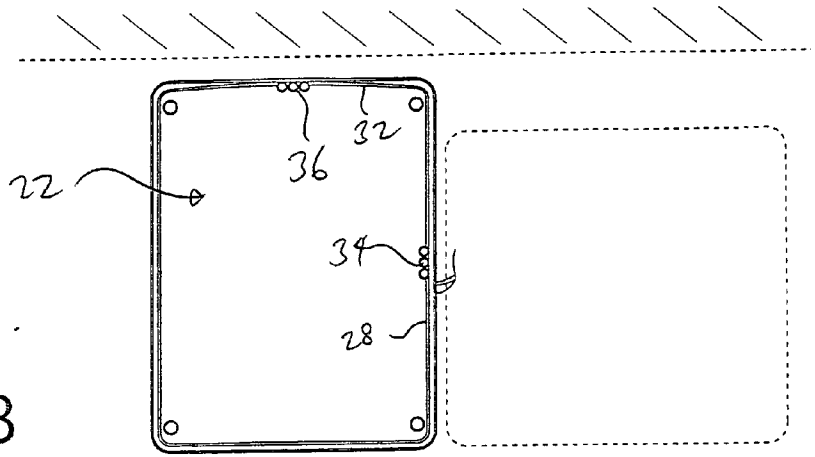
FIG. 10B illustrates the assembly of FIG. 1 oriented with a long edge adjacent a kitchen sink.

For example, if the disk rack 10 is oriented with the long edge 28 of the base 22 being positioned adjacent the kitchen sink (see FIG. 10B), the water stopper 38 can be secured to the outlets 36 and the spout 40 can be secured to the outlets 34 (adjacent long edge 28), as also shown in FIGS. 3 and 4. When the disk rack 10 is used in this orientation, the user can lift up the opposite long edge 26 and pivot the legs 94 and 96 (along the opposite long edge 26) to the deployed position, while maintaining the leg 92 in the storage position. See FIG. 4. With the legs 94 and 96 deployed, the base 22 (and the dish rack 10 thereon) will be tilted at an angle so that all the water on the base 22 will be flowed by gravity towards the long edge 28 and the outlets 34, where the water can then flow through the outlets 34 and along the concave body 42 of the spout 40 to be emptied into the kitchen sink. A sloped surface 29 can be provided along the long edge 28 (see FIG. 3) so that the sloped surface 29 can guide the water on the base 22 towards the outlets 34. The water stopper 38 prevents water from draining through the outlets 36 along the short edge 32 because each bump 68 is aligned with an outlet 36 and prevents water from flowing therethrough.

Alternatively, if the disk rack 10 is oriented with the short edge 32 of the base 22 being positioned adjacent the kitchen sink (see FIG. 10A), the water stopper 38 can be secured to the outlets 34 and the spout 40 can be secured to the outlets 36 (adjacent short edge 32), as also shown in FIGS. 5 and 6. When the disk rack 10 is used in this orientation, the user can lift up the opposite short edge 30 and pivot the legs 92 and 94 (along the opposite short edge 30) to the deployed position, while maintaining the leg 96 in the storage position. See FIG. 6. With the legs 92 and 94 deployed, the base 22 (and the dish rack 10 thereon) will be tilted at an angle so that all the water on the base 22 will be flowed by gravity towards the short edge 32 and the outlets 36, where the water can then flow through the outlets 36 and along the concave body 42 of the spout 40 to be emptied into the kitchen sink. A sloped surface 31 can be provided along the short edge 32 (see FIG. 5) so that the sloped surface 31 can guide the water on the base 22 towards the outlets 36. The water stopper 38 prevents water from draining through the outlets 34 along the long edge 28 because each bump 68 is aligned with an outlet 34 and prevents water from flowing therethrough.

Thus, the present invention provides a base 22 for use with a dish rack 10 which allows the dish rack 10 to be oriented with either a long edge or a short edge adjacent the kitchen sink while facilitating convenient draining of the water into the kitchen sink without having to change the orientation of the dish rack 10 during use.

Figure 11:
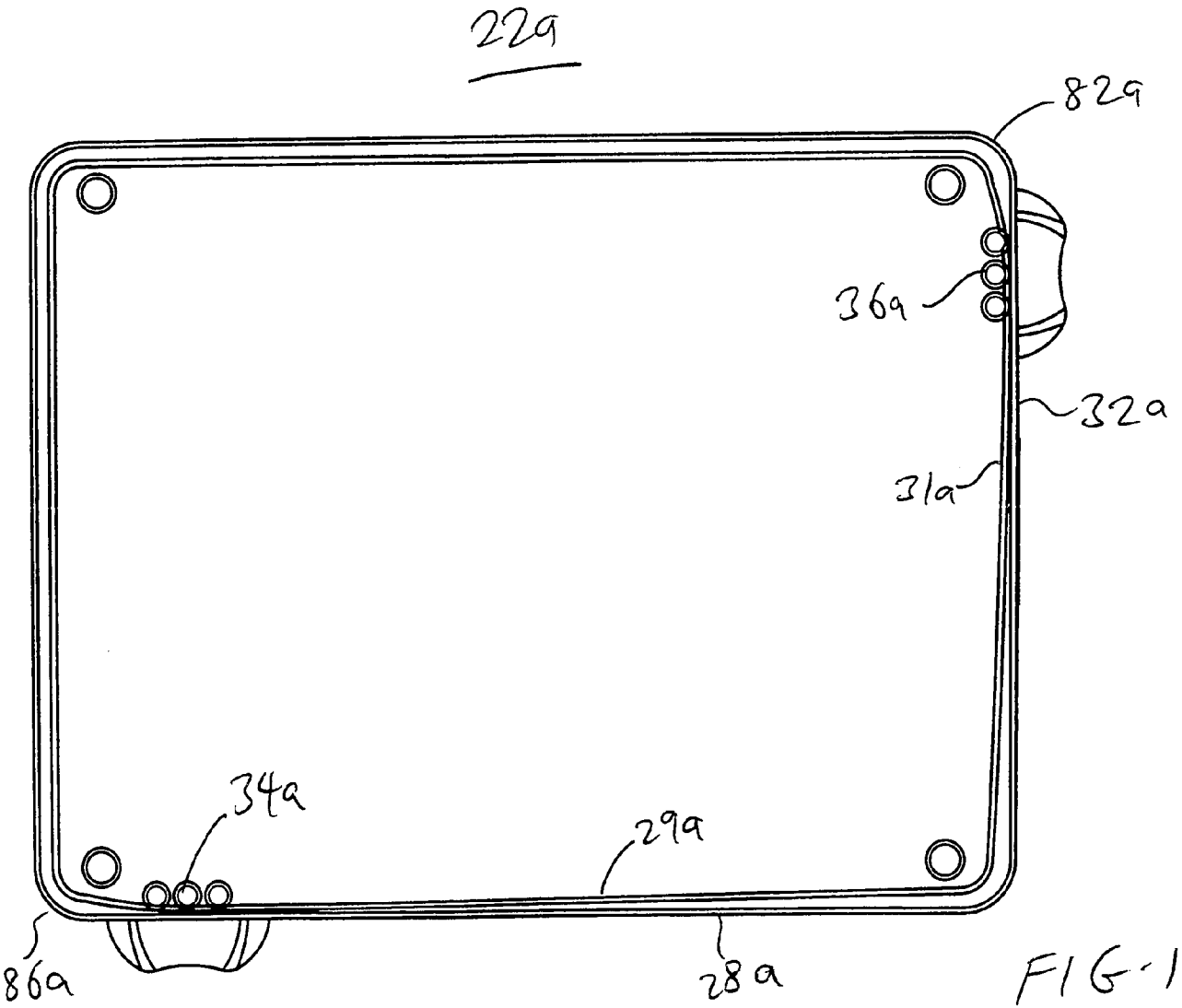
FIG. 11 is a top plan view illustrating modifications made to the locations of the water outlets for the assembly of FIG. 1.

The locations of the water outlets 34 and 36 can be varied without departing from the spirit and scope of the present invention. For example, the water outlets 34 and 36 are illustrated as being positioned at about the center of the edges 28 and 32, respectively. However, the water outlets 34 and 36 can be positioned anywhere along the edges 28 and 32, respectively. FIG. 11 illustrates a base 22*a* that is identical to the base 22, except that the water outlets 34*a* and 36*a* are positioned along the edges 28*a* and 32*a* (and the sloped surfaces 29*a* and 31*a*), respectively, adjacent the corners 86*a* and 82*a*, respectively. In other words, the water outlets 34*a* and 36*a* are almost 180 degrees apart from each other.

Figure 12:
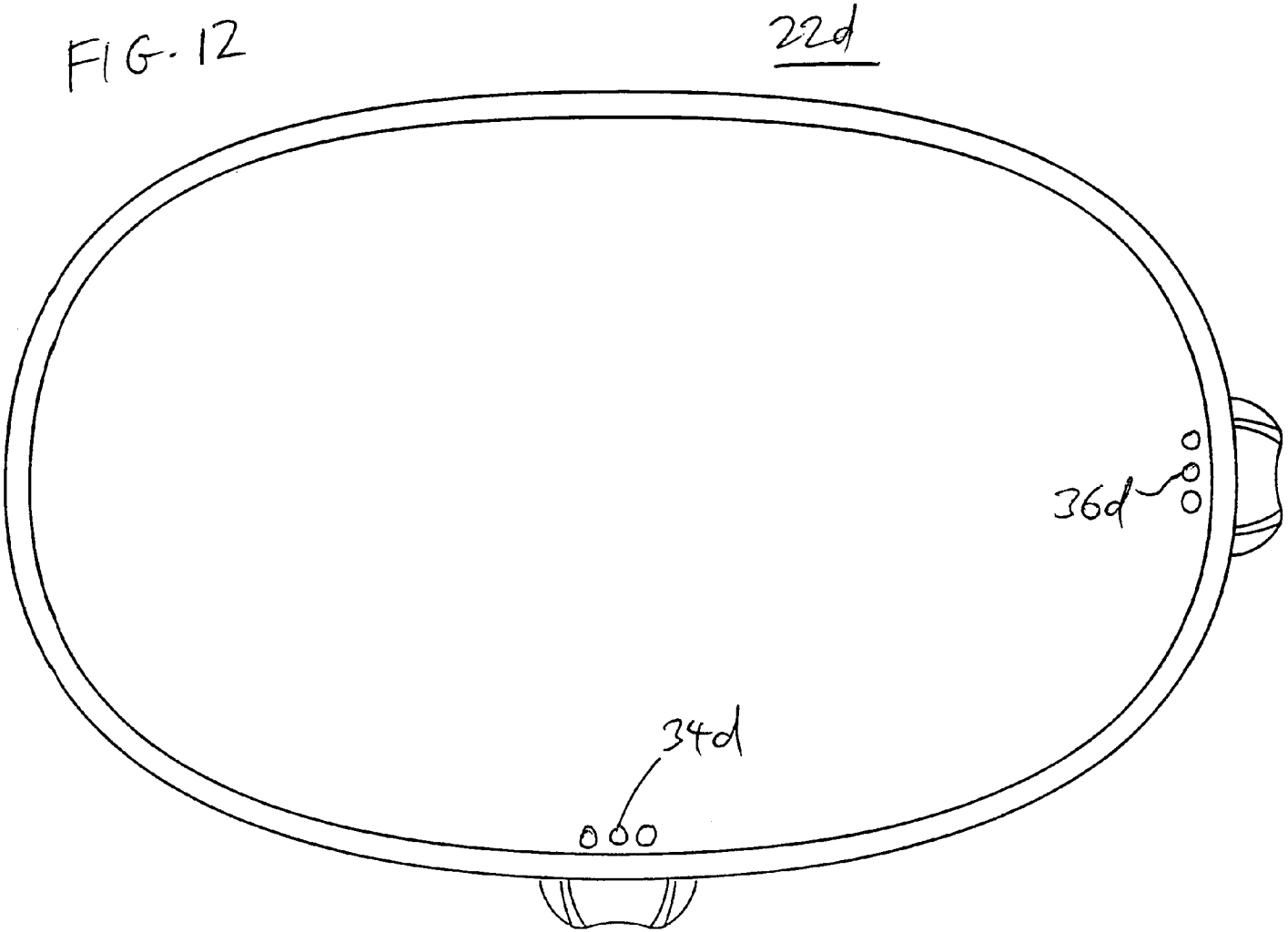
FIG. 12 is a top plan view illustrating modifications made to the shape of the assembly of FIG. 1.
Figure 13:
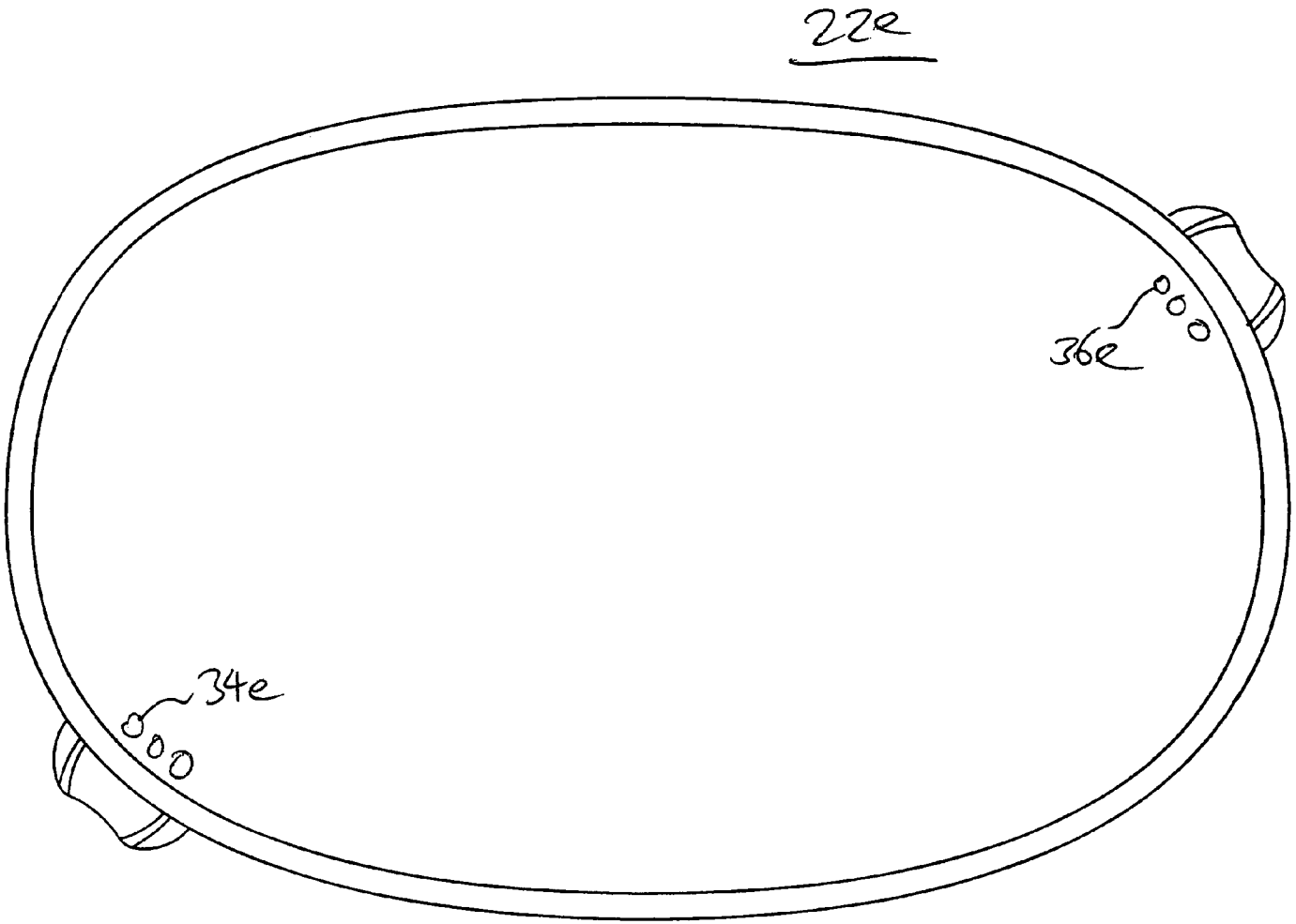
FIG. 13 is a top plan view illustrating modifications made to the shape of the assembly of FIG. 11.

The shape of the base 22 can also be varied without departing from the spirit and scope of the present invention. For example, even though FIGS. 1-11 illustrate bases 22 and 22*a* that are four-sided, the principles of the present invention can be extended to bases having different shapes. FIG. 12 illustrates a base 22*d* that is identical to the base 22 except that the base 22*d* has a generally oval configuration, with the sets of water outlets 34*d* and 36*d* positioned at about the same locations as the water outlets 34 and 36, respectively (i.e., about 90 degrees apart from each other). FIG. 13 illustrates a base 22*e* that is identical to the base 22*a* (see FIG. 11) except that the base 22*e* has a generally oval configuration, with the sets of water outlets 34*e* and 36*e* positioned at the about the same locations as the water outlets 34*a* and 36*a*, respectively (i.e., about 180 degrees apart from each other).

While the description above refers to particular embodiments of the present invention, it will be understood that many modifications may be made without departing from the spirit thereof. The accompanying claims are intended to cover such modifications as would fall within the true scope and spirit of the present invention.

As a non-limiting example, the legs 92, 94, 96 can be replaced by removable blocks. For example, two removable blocks can be positioned at the corners 82 and 84 if the spout 40 is secured along the long edge 28, and the same two removable blocks can be positioned at the corners 86 and 84 if the spout 40 is secured along the short edge 32.

As another non-limiting example, instead of providing three pivoting legs 92, 94, 96 at three separate corners, it is also possible to position one pivoting leg (similar to leg 96) at the center of the long edge 26, and another pivoting leg (similar to leg 92) at the center of the short edge 30. Alternatively, an additional pivoting leg can be provided at the corner 80 to provide four pivoting legs.

What is claimed is:

1. A dish rack assembly, comprising:

a dish rack; and a base having a bottom wall on which the dish rack is positioned, the base having:

a first edge having a first water outlet provided adjacent the first edge;

a second edge having a second water outlet provided adjacent the second edge, the second edge being adjacent to the first edge;

at least a first pivoting leg position adjacent a third edge that is opposite to the first edge; and at least a second pivoting leg position adjacent a fourth edge that is opposite to the second edge, wherein one of the first and second pivoting legs is selectively pivoted away from plane of the bottom wall to raise the height of the bottom wall at said one of the first and second pivoting leg, with another one of the first and second pivoting legs being pivoted towards the plane of the bottom wall to lower the height of the bottom wall at said another one of the first and second pivoting leg, thereby selectively tilting the third edge with respect to the first edge or the fourth edge with respect to the second edge.

2. The assembly of claim 1, further including:

a removable water stopper that is secured to either the first water outlet or the second water outlet.

3. The assembly of claim 2, further including:

a removable spout that is secured to the other of the first water outlet or the second water outlet.

4. The assembly of claim 1, further including:

a third leg positioned at a corner between the third and fourth edges.

5. The assembly of claim 4, wherein the third leg is a pivoting leg that pivots away from plane of the bottom wall to raise the height of the bottom wall at the pivoting leg.

6. A dish rack assembly, comprising:

a dish rack; and a base having a bottom wall on which the dish rack is positioned, the base having:

a first pivoting leg positioned adjacent a first edge to tilt the first edge with respect to a third edge opposite to the first edge;

a second pivoting leg positioned adjacent a second edge that is adjacent to the first edge to tilt the second edge with respect to a fourth edge opposite to the second edge, wherein one of the first and second pivoting legs is selectively pivoted away from plane of the bottom wall to raise the height of the bottom wall at said one of the first and second pivoting leg, with another one of the first and second pivoting legs being pivoted towards the plane of the bottom wall to lower the height of the bottom wall at said another one of the first and second pivoting leg, thereby selectively tilting the first edge with respect to the third edge or the second edge with respect to the fourth edge.

7. The assembly of claim 6, further including:

a third leg positioned at a corner between the first and second edges.

8. A dish rack assembly, comprising:

a dish rack; and a base having a bottom wall on which the dish rack is positioned, the base having:

a first edge having a first water outlet provided adjacent the first edge;

a second edge having a second water outlet provided adjacent the second edge, the second edge being adjacent to the first edge;

a first pivoting leg positioned adjacent a third edge that is opposite to the first edge;

a second pivoting leg positioned adjacent a fourth edge that is opposite to the second edge; and a removable water stopper that is secured to either the first water outlet or the second water outlet, wherein one of the first and second pivoting legs is selectively pivoted away from plane of the bottom wall to raise the height of the bottom wall at said one of the first and second pivoting leg, with another one of the first and second pivoting legs being pivoted towards the plane of the bottom wall to lower the height of the bottom wall at said another one of the first and second pivoting leg, thereby selectively tilting the third edge with respect to the first edge or the fourth edge with respect to the second edge.

9. The assembly of claim 8, further including:

a third leg positioned at a corner between the third and fourth edges.

10. A dish rack assembly, comprising:

a dish rack; and a base having a periphery and a bottom wall on which the dish rack is positioned, the base having a first water outlet and a second water outlet that are provided adjacent the periphery, with the first and second water outlets spaced apart from each other;

the base further comprising a first pivoting leg positioned at a first location adjacent the periphery opposite to the first water outlet, wherein the first pivoting leg tilts the first location with respect to the first water outlet; and a second pivoting leg positioned at a second location adjacent the periphery opposite to the second water outlet, wherein the second pivoting leg tilts the second location with respect to the second water outlet, wherein one of the first and second pivoting legs is selectively pivoted away from plane of the bottom wall to raise the height of the bottom wall at said one of the first and second pivoting leg, with another one of the first and second pivoting legs being pivoted towards the plane of the bottom wall to lower the height of the bottom wall at said another one of the first and second pivoting leg, thereby selectively tilting the periphery adjacent the first location with respect to the first water outlet or the periphery adjacent the second location with respect to the second water outlet.

11. The assembly of claim 10, wherein the first and second water outlets spaced apart from each other by 90 degrees.

12. The assembly of claim 10, further including;

a removable water stopper that is secured to either the first water outlet or the second water outlet.

13. The assembly of claim 6, wherein a first water outlet is provided adjacent the third edge, and a second water outlet is provided adjacent the fourth edge.

14. The assembly of claim 1, wherein the first edge is orthogonal to the second edge.

15. The assembly of claim 6, wherein the first edge is orthogonal to the second edge.

16. The assembly of claim 8, wherein the first edge is orthogonal to the second edge.

17. The assembly of claim 4, wherein only one of the first and second pivoting legs is applied in association with the third leg to provide water drainage, wherein the first pivoting leg and the third leg are applied to tilt the third edge with respect to the first edge to selectively drain water through the first water outlet, and the second pivoting leg and the third leg are applied along with the third leg to tilt the fourth edge with respect to the second edge to selectively drain water through the second water outlet.

18. The assembly of claim 7, wherein only one of the first and second pivoting legs is applied in association with the third leg to provide water drainage, wherein the first pivoting leg and the third leg are applied to tilt the first edge with respect to the third edge to selectively drain water at the third edge, and the second pivoting leg and the third leg are applied to tilt the second edge with respect to the fourth edge to selectively drain water at the fourth edge.

19. The assembly of claim 9, wherein only one of the first and second pivoting legs is applied in association with the third leg to provide water drainage, wherein the first pivoting leg and the third leg are applied to tilt the third edge with respect to the first edge to selectively drain water through the first water outlet, and the second pivoting leg and the third leg are applied to tilt the fourth edge with respect to the second edge to selectively drain water through the second water outlet.

20. The assembly of claim 10, wherein the base further comprising a third leg positioned at a third position adjacent the periphery, between the first position and the second position, and wherein only one of the first and second pivoting legs is applied in association with the third leg to provide water drainage, wherein the first pivoting leg and the third leg are applied to tilt the first and third locations with respect to the first water outlet to selectively drain water through the first water outlet, and the second pivoting leg and the third leg are applied to tilt the second and third locations with respect to the second water outlet to selectively drain water through the second water outlet.

21. The assembly of claim 1, wherein the base is separate from the dish rack.

22. The assembly of claim 21, wherein the dish rack comprises a wire frame.

23. The assembly of claim 6, wherein the base is separate from the dish rack.

24. The assembly of claim 23, wherein the dish rack comprises a wire frame.

25. The assembly of claim 10, wherein the base is separate from the dish rack.

* * * * *